United States Patent [19]

Platt

[11] Patent Number: 4,727,703

[45] Date of Patent: Mar. 1, 1988

[54] SUSPENDED CEILING GRID STRUCTURE

[75] Inventor: William J. Platt, Collingdale, Pa.

[73] Assignee: National Rolling Mills Inc., Malvern, Pa.

[21] Appl. No.: 886,838

[22] Filed: Jul. 18, 1986

[51] Int. Cl.[4] ..... E04C 2/42

[52] U.S. Cl. ..... 52/664; 52/484; 52/486

[58] Field of Search ..... 52/484, 486, 664

[56] References Cited

U.S. PATENT DOCUMENTS

| | | | |
|---|---|---|---|
| 2,041,773 | 5/1936 | Manske . | |
| 2,896,752 | 7/1959 | Wilde . | |
| 2,990,921 | 7/1961 | Wilde . | |
| 3,169,614 | 2/1965 | McCoy . | |
| 3,270,479 | 9/1966 | Weinar . | |
| 3,374,596 | 3/1968 | O'Brien et al. . | |
| 3,378,976 | 4/1968 | Meredith, Jr. . | |
| 3,722,933 | 3/1973 | Nute, Jr. . | |
| 3,979,874 | 9/1976 | Cubbler, Jr. et al. | 52/664 |
| 4,011,707 | 3/1977 | Nute, Jr. . | |

FOREIGN PATENT DOCUMENTS

| | | | |
|---|---|---|---|
| 250327 | 1/1964 | Australia | 52/484 |

*Primary Examiner*—William F. Pate, III

*Assistant Examiner*—Creighton Smith

*Attorney, Agent, or Firm*—John F. A. Earley; John F. A. Earley, III

[57] ABSTRACT

In a suspended ceiling grid structure adapted to support ceiling tiles or the like, connecting apparatus between ceiling grid inverted T main and cross members disposed at right angles to each other and having upright central fins and bottom horizontal flanges comprise a vertically disposed belt loop formed in the central fin of the main member, a locking tongue extending from each end of the cross members in opposite directions at substantially right angles from the central fin of the cross member, a stiffening bead formed in the central fin of the cross member at each end of the cross member and extending through the locking tongues to an outer end portion of the locking tongues, a locking bump formed in the stiffening bead in the outer end portion of the locking tongues, positive stop shoulders at the top and bottom of the locking tongue contacting the rear edge of the belt loop on the main member when the locking tongue is fully inserted into the belt loop, and a sloping surface on the rear of the locking bump which the loop presses against to urge stop shoulders against the rear edge of the belt loop.

8 Claims, 5 Drawing Figures

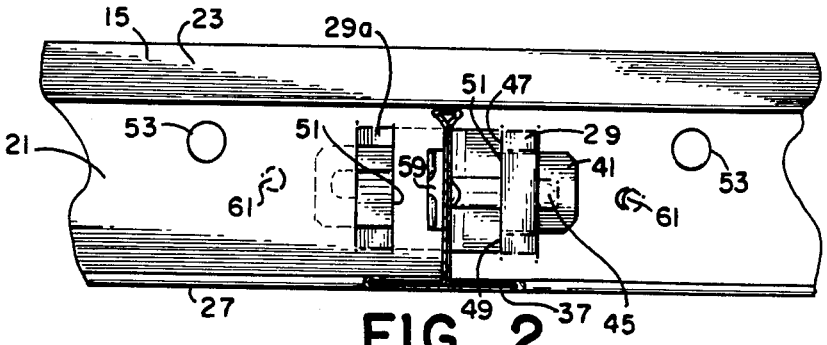
FIG. 2
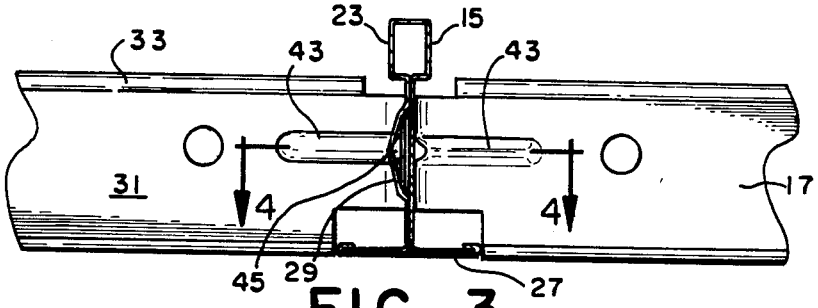
FIG. 3
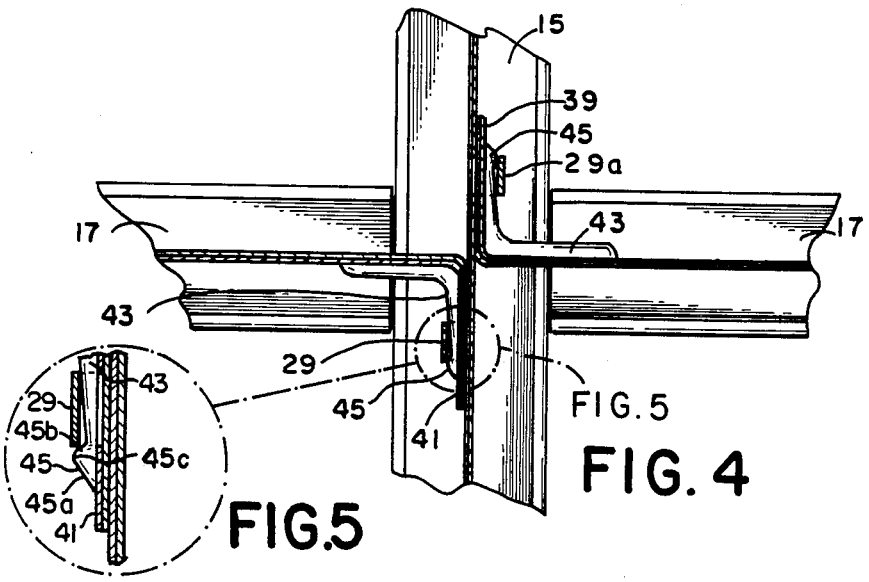
FIG. 5
FIG. 4
FIG.5

SUSPENDED CEILING GRID STRUCTURE

BACKGROUND OF THE INVENTION

1. Field of the Invention

This invention relates to improvements in a suspended ceiling grid structure, and more particularly concerns improvements in a suspended ceiling grid structure adapted to support ceiling tiles or the like, and improvements in connecting means between the elements of the grid structure.

2. Description of the Prior Art

Suspended ceiling grid structures for supporting ceiling tiles are known in the art. Typically, such grid structures have a plurality of main beams connected together by a plurality of cross tees.

When it is desired to gain access to the space above the suspended ceiling, a problem with known grid structures has been providing a connecting means that allows a cross tee to be removed without damage so that it subsequently may be reattached.

Another problem has been providing a grid structure with a means of assuring proper alignment of opposing cross tees.

Still another problem has been providing a grid structure having a reinforced connecting means that allows for a reduction in the amount of metal required in the connecting means, thereby decreasing costs.

SUMMARY OF THE INVENTION

Accordingly, it is an object of this invention to provide a suspended ceiling grid structure which overcomes the foregoing problems.

Another object of this invention is to provide a grid structure that has a connecting means with a slidelock feature. Another object is to provide a grid structure having a connecting means that allows for easy installation as well as easy disassembly.

These and other objects are accomplished by providing a suspended ceiling grid structure adapted to support ceiling tiles or the like that comprises a plurality of inverted T main beams arranged in spaced-apart, substantially parallel relationship, each main beam having a central fin or web and oppositely disposed flanges, cross tees connecting adjacent main beams, each cross tee having a central fin or web and oppositely disposed bottom flanges, vertically disposed belt loops formed in the central fin of the main beams, a locking tongue extending from each end of the cross tees in opposite directions at substantially right angles from the cross tee central fin, the locking tongue being releasably engaged by the belt loop, a stiffening bead formed in the central fin of the cross tees at each end of the cross tees and extending through the central portion of the locking tongues to an outer end portion of the locking tongues, a locking bump formed in the stiffening bead in the outer end portion of the locking tongues, positive stop shoulders at the top and bottom of the locking tongue contacting the belt loop on the main beam when the locking tongue is fully inserted into the belt loop, and sloping means on the bump which the loop presses against to urge the stop shoulders against the rear edge of the loop.

BRIEF DESCRIPTIN OF THE DRAWINGS

FIG. 2 is a view in section taken as indicated by the lines and arrows 2—2 which appear in FIG. 1;

FIG. 3 is a view in section taken as indicated by the lines and arrows 3—3 which appear in FIG. 1;

FIG. 4 is a view in section taken as indicated by the lines 4—4 which appear in FIG. 3; and FIG. 5 is a partial enlarged view of the area indicated by FIG. 4.

DETAILED DESCRIPTION

Figure 1:
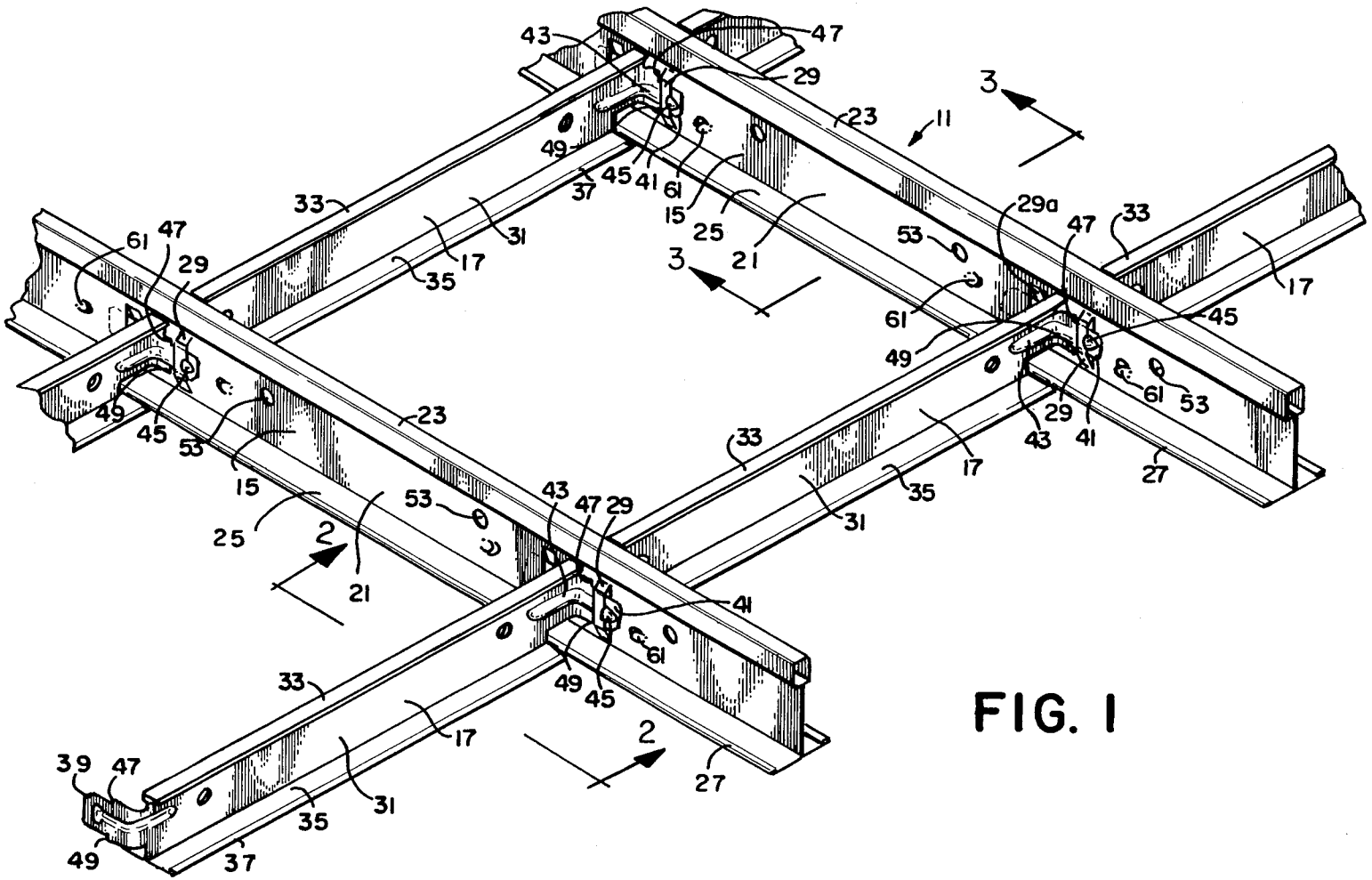
FIG. 1 is a fragmentary view in perspective of a suspended ceiling grid structure constructed in accordance with the invention.

Turning now to the drawings, there is shown a suspended ceiling grid structure 11 adapted to support ceiling tiles or the like, which comprises a plurality of main beams 15 arranged in spaced-apart, substantially parallel relationship, and cross tees 17 which connect the adjacent main beams 15 together.

Each main beam 15 has an inverted T shape, and includes a central fin or web 21 having a reinforcing bead 23 at the top and a pair of oppositely disposed flanges 25 at the bottom. A capping 27 is mounted on flanges 25. Pairs of vertically disposed belt loops 29, **29*a* are formed in the central fin 21 of main beam 15 with one belt loop 29 of each pair being formed on one side of main beam fin 21 and the other loop 29*a*** of each pair being formed on the opposite side.

Cross tees 17 are also of inverted T construction and each includes a central fin or web 31, a reinforcing bead 33 at the top of central fin 31, flanges 35 extending from the bottom of central fin 31, and a capping 37 mounted on flanges 35.

Locking tongues 39, 41 are formed integrally with each cross tee 17 and extend in opposite directions from each end of cross tee 17 at substantially right angles to cross tee central fin 31. A stiffening bead or rib 43 is formed in the central fin 31 at each end of cross tee 17 and extends through the central portion of locking tongues 39, 41 to an outer end portion of locking tongues 39, 41. Ribs 43 are provided to strengthen the ends of cross tees 17 and locking tongues 39, 41.

A locking bump 45 is formed in the outer end portion of each rib 43, and has an entrance ramp or forward surface **45*a* which slopes rearwardly and outwardly from the fin of the tongue, and a rear surface 45*b* that slopes rearwardly toward the fin. Belt loop 29, 29*a* presses against rear surface 45*b* to urge the locking tongues 39, 41 into tight engagement, since the belt loops 29, 29*a* tend to spring back and to ride down the sloped surface 45*b* of locking bump 45. Since the rear surface 45*b* of locking bump 45 is sloped, the tongues may be removed from belt loops 29, 29*a* without causing damage to the cross tee 17 by sliding the locking tongues 39, 41 rearwardly out of the belt loops 29, 29*a*. A hump or shoulder 45*c* is positioned between forward surface 46*a* and rear surface 45*b***.

Positive stop shoulders 47, 49 are provided at the top and bottom of each locking tongue 39, 41 for contacting the rear edge of belt loops 29, **29*a* on main beam 15 to assure proper alignment of the opposing cross tees 17. When both stop shoulders 47, 49 are abutting the rear edge of the belt loop, the center line of the cross tee lines up with the center line of another cross tee connected to the other side of main beam 15**.

said loop opening extending a smaller distance from the fin than the locking bump so that the bump moves the loop away from the fin during insertion of the tongue, and the loop snaps back toward the fin when the tongue is fully inserted.

4. Connecting means between ceiling grid inverted tee main and cross members disposed at right angles to each other and having upright central fins and bottom horizontal flanges, comprising a vertically disposed belt loop formed in the central fin of the main member and having a rear edge and a forward edge, a locking tongue extending from each end of the cross members in opposite directions at substantially right angles from the central fin of the cross member, positive stop shoulders at the top and bottom of the locking tongue for contacting the rear edge of the belt loop on the main member when the locking tongue is fully inserted into the belt loop, and a locking bump formed in the outer end portion of the locking tongues having a forward surface which slopes away from the main member fin for easy insertion into the loop, the locking bump having a rear surface sloping toward the fin which is pressed against by the loop to urge the stop shoulders into tight engagement with the rear edge of the loop.

5. The connecting means of claim 4, the belt loop having an entrance portion which extends outwardly from the main member central fin to form a loop opening for easy insertion therein of the locking tongue.

6. The connecting means of claim 5, said loop opening extending outwardly from the fin a smaller distance than the locking bump so that the locking bump cams the loop away from the fin when the tongue is being inserted through the loop and the loop snaps back toward the fin when the tongue is fully inserted.

7. The connecting means of claim 4, including a stiffening rib formed in the central fin of the cross member at each end of the cross member and extending through the locking tongues to an outer end portion of the locking tongues and tapering into the locking bump.

8. Connecting means between ceiling grid inverted tee main and cross members disposed at right angles to each other and having upright central fins and bottom horizontal flanges, comprising a vertically disposed belt loop having a rear edge and a forward edge formed in the central fin of the main member, a locking tongue extending from each of the cross members in opposite directions at substantially right angles from the central fin of the cross member, a stiffening bead formed in the central fin of the cross member at each end of the cross member and extending through the locking tongues to an outer end portion of the locking tongues and tapering into the locking bump, positive stop shoulders at the top and bottom of the locking tongue for contacting the rear edge of the belt loop on the main member when the locking tongue is fully inserted into the belt loop, and a locking bump formed in the stiffening bead in the outer end portion of the locking tongues having a forward surface which slopes rearwardly away from the main member fin for easy insertion into the loop, the locking bump having a rear surface sloping rearwardly toward the fin with the loop pressing against the locking bump rear surface to urge the stop shoulders into tight engagement with the rear edge of the loop, the belt loop having an entrance portion which extends outwardly from the main member central fin to form a loop opening for easy insertion therein of the locking tongue, said loop opening extending outwardly from the fin a smaller distance than the locking bump so that the locking bump cams the loop away from the fin when the tongue is being inserted through the loop and the loop snaps back toward the fin when the tongue is fully inserted.

* * * * *